US006319386B1

(12) United States Patent
Reynolds

(10) Patent No.: US 6,319,386 B1
(45) Date of Patent: Nov. 20, 2001

(54) SUBMERGED ARRAY MEGASONIC PLATING

(75) Inventor: H. Vincent Reynolds, Marcellus, NY (US)

(73) Assignee: Reynolds Tech Fabricators, Inc., East Syracuse, NY (US)

( * ) Notice: Subject to any disclaimer, the term of this patent is extended or adjusted under 35 U.S.C. 154(b) by 0 days.

(21) Appl. No.: 09/497,224

(22) Filed: Feb. 3, 2000

(51) Int. Cl.[7] ..... C25D 5/20; C25D 7/12; B06B 1/00; B01D 17/06

(52) U.S. Cl. ..... 205/148; 205/157; 427/600; 210/748

(58) Field of Search ..... 205/148, 157; 204/273; 427/600, 457; 210/748

(56) References Cited

U.S. PATENT DOCUMENTS

| | | | |
|---|---|---|---|
| 4,602,184 | 7/1986 | Meitzler | 310/322 |
| 4,686,406 | 8/1987 | Meitzler | 310/322 |
| 4,869,278 | 9/1989 | Bran | 134/184 |
| 5,383,484 | 1/1995 | Thomas et al. | 134/184 |
| 5,625,249 | 4/1997 | Grant | 310/334 |
| 5,669,971 * | 9/1997 | Bok et al. | 118/300 |

OTHER PUBLICATIONS

PCT Systems, Inc., "New Wave in Ultra–Clean Sonic Particle Removal," product brochure, 1999 no month available.

* cited by examiner

*Primary Examiner*—Edna Wong
(74) *Attorney, Agent, or Firm*—Bernhard P. Molldrem, Jr.

(57) ABSTRACT

A megasonic plating technique employs a submerged megasonic transducer array (22) to create a ridge (38) of electrolyte that extends upward above a plating tray (12). A chuck (40) holds the substrate (42) so the face to be plated is oriented downwards. A controlled power supply (32) for the megasonic transducer array (22) energizes selected transducer cells (36) to create the ridge (38) of electrolyte and cause it to move or walk across the face of the substrate. This technique avoids need for drive mechanisms for either the tray (12) or the chuck (40). A annular anode element (24) may be positioned above the transducer array, and may be a consumable anode. This technique may be used for electroplating, electroless plating, or for other wet chemistry techniques such as planing or etching.

7 Claims, 2 Drawing Sheets

SUBMERGED ARRAY MEGASONIC PLATING

BACKGROUND OF THE INVENTION

This invention relates to wet process chemistry treatment of substrates, e.g., semiconductor wafers and the like, and is more particularly directed to a technique for plating a flat workpiece in a manner that is efficient and also minimizes surface defects. The invention also concerns a technique that facilitates robotic handling of the articles.

Electroplating and electroless plating play significant roles in the production of many rather sophisticated technology products. These techniques have recently evolved for metallization of semiconductor devices. Recently there has been interest in plating techniques to form copper conductors on silicon to increase the power or speed of semiconductor devices. Electroplating and electroless plating may also be used to prepare recordable compact disk blanks. Other related wet-process techniques include etching, stripping and planing.

Several techniques for wet-process treating or coating are described in patent literature.

One recent technique that employs a laminar flow sparger or injection nozzle within the plating bath is described in my recent U.S. Pat. No. 5,597,460, granted Jan. 28, 1997. The means described there achieve an even, laminar flow across the face of the substrate during the plating operation. A backwash technique carries the sludge and particulate impurities away from the article to be plated, and produces a flat plated article of high tolerance, such as a high-density compact disc master or semiconductor wafer. The techniques in that patent improve the flow regime for the plating solution within the tank or cell, as the flow regime is regarded as being crucial for successful operation. Flow regime is affected by such factors as tank design, fluid movement within the process vessel, distribution of fluid within the vessel and at the zone of introduction of the solution into the vessel, and uniformity of flow of the fluid as it is contacts and flows across the substrate in the plating cell.

In the plating cell as described in said U.S. Pat. 5,597,460, a plating bath contains the electrolyte or plating solution, and the substrate to be plated is submerged in the solution. A sparger or equivalent injection means introduces the solution into the plating bath and creates a laminar flow of the electrolyte or plating solution across the surface of the substrate to be plated. A circulation system draws off the solution from the anode chamber, together with any entrained particles, and feeds the solution through a microfilter so that all the particles of microscopic size or greater are removed from the plating solution. Then the filtered solution is returned to the sparger and is reintroduced into the plating cell.

The flow regime as described in said U.S. Pat No. 5,597,460 is further improved by the geometry of the well that forms the tank for the plating bath. The well has a cylindrical wall that is coaxial with the axis of the substrate. This arrangement was intended to avoid corners and dead spaces in the plating cell, where either the rotation of the substrate or the flowing movement of the plating solution might otherwise create turbulences.

An increased evenness in plating is achieved by the technique of my U.S. Pat. No. 5,634,564 in which a rotary blade or wiper is positioned in the plating bath.

Electroless plating is favored in many applications, and especially in those where there is no electrically conductive layer that could serve as a cathode. Accordingly, electroless plating is now seen as an economical alternative to sputtering or vacuum deposition. This is especially true for metals that are difficult to deposit using sputtering or plasma techniques. One advantageous approach to electroless plating is disclosed in my earlier U.S. Pat. No. 5,865,894. In that arrangement, a megasonic transducer adjacent the floor of the plating cell applies megasonic energy at a frequency of about 0.2 to 5 MHz to the solution. The frequency can be above 1 MHz, and in some cases above 5 MHz. The megasonic waves distribute the solution evenly on the substrate, and also break up any bubbles or concentrations that may lead to defects in the plated surface.

Megasonic plating techniques can improve the electroplating of silicon wafers. An example of such technique, in which the flow regime is firther improved by imposing a rotary motion, is described in my U.S. Pat. No. 5,865,894. The megasonic transducer and the rotary blade can be incorporated together in a plating cell, as described and illustrated in my U.S. Pat. No. 5,904,827. The techniques described in my U.S. Pat. No. 5,932,077 permit mounting of the substrate and lowering of the substrate into the plating cell to be automated or robotized. Automation and robotization of the insertion, removal, and transport of the workpiece from one process cell to another make it possible to conduct the entire multiple-step plating operation in a clean or super-clean environment. In that technique the carrier for the substrate is disposed on a sealable door for the plating cell. The door opens to a loading position, which is preferably the horizontal position, and closes to a position which preferably holds the substrate vertically in the plating chamber. The door sealably seats onto an opening in a side wall of the cell. For electroplating use, a cathode ring may be disposed at the periphery of the door opening for making electrical contact with the substrate when the door is closed. This arrangement can lend itself to robotization of the plating process, but nevertheless requires the transfer of the substrate from a transfer holder to a platen associated with the plating cell. Moreover, mechanical and fluid handling considerations must be addressed because of the need to move the substrate between horizontal and vertical orientations.

High precision electroplating in the past has required either rotation of the substrate or rotation of a wiper to induce the removal of hydrogen bubbles from the surface to obtain uniform plating free of defects. For this reason the substrate had to be positioned either in a vertical orientation or in a diagonal or slant orientation, rather than horizontal, so that the bubbles would not collect on the surface. Until quite recently, there has been no effective technique for plating, etching, or stripping wafers or other substrates in a horizontal, circuit-side-down, orientation. My now-pending U.S. patent application Ser. No. 09/314,400, filed May 15, 1999, now U.S. Pat. No. 6,217,735, describes a technique for electroplating in which an elongated megasonic transducer produces a ridge of electrolyte that sweeps across the face of the wafer or substrate. The substrate is held horizontal, and with the planar face, i.e., the circuit side of the wafer of other substrate, oriented downwards. The associated electroplating bath employs an elongated, horizontally extending tray that has an open top. An elongated, horizontally extending megasonic transducer is situated at the base of the tray, and an anode extends horizontally above the transducer. A sparger arrangement supplies a flow of a process fluid, such as an electrolyte, into the tray, and the megasonic transducer creates a transverse ridge of the electrolyte or other wet process fluid that projects upwards from the tray. This ridge can contact a substrate passing over the tray. Plating involves applying megasonic energy to the transducer to create the transverse ridge of said electrolyte. Plating current is applied between the anode and the substrate. The substrate is oriented horizontally and face down so it is in position to contact the transverse ridge of electrolyte, and then either the substrate holder or the tray is moved in the direction across the ridge to effect relative motion as between substrate and tray so that the ridge sweeps across the face of the substrate. A rinser may be positioned alongside the electrolyte tray for rinsing the substrate after the plating operation. The rinser may also involve employ a megasonic transducer to create a ridge of rinse solution. In the technique of patent application Ser. No. 09/314,400, the anode is preferably a transverse metal rod or similar conductive member that extends parallel to the transducer and just above it within the electrolyte. Alternatively, the anode can be a stainless steel surface incorporated as a lens of the transducer. The holder for the wafer or other substrate may be a heated or unheated chuck. The megasonic energy also heats the substrate where the ridge contacts it, and in some cases may partially or fully heat-treat the metallization.

Preferably, the sparger arrangement creates a non-turbulent flow of the electrolyte that emanates from each side of the megasonic transducer, such as rows of openings, one row disposed along one side of the transducer, and one row disposed along the other side.

In this arrangement, the chuck or tray has to move back and forth mechanically. This requires a significant amount of mechanical drive equipment. The horizontal drive can be expensive and complex, and require significant service and repair. In addition, the moving parts can be a source of particulate contaminants that may fall into the plating bath in the tray. Also, the speed and direction of sweep are limited, and so there is not much flexibility afforded in the pattern of the ridge or how it moves across the substrate.

Accordingly, it would be advantageous to provide wet-process equipment in which a ridge can be generated and controlled for plating a substrate, but where the mechanical moving parts are kept to a minimum, and where there is increased flexibility in speed, shape, and direction of motion of the ridge across the substrate.

At this time, there are available submersible megasonic arrays, which contain a number of transducers arranged in a grid, and which are actuated by microprocessor control. These are typically used for cleaning applications where a number of wafers are carried in a cassette or "boat" and are submerged in the cleaning or rinse solution and are all cleaned at the same time. To date, no one has used this type of megasonic transducer arrangement to create a controlled ridge that extends above the surface of the liquid.

OBJECTS AND SUMMARY OF THE INVENTION

Accordingly, it is an object of this invention to provide an arrangement for electroplating, electroless plating, or other wet-process chemistry, which results in increased evenness of the metallic material on a wafer or other substrate, and which avoids the drawbacks of the prior art.

It is another object of this invention to provide a wet-chemistry arrangement in which the substrate is maintained in a horizontal position, and which can be adapted easily for automated wafer handling.

It is a further object to provide a wet-process arrangement which contains a minimum of mechanical moving parts, and over which greater control and flexibility can be exercised than has been possible previously.

According to one aspect of the present invention, a planar face of a substrate is plated with a metal layer. Plating is carried out by means of a plating bath wherein a tray has an open top, a megasonic transducer array is situated in the tray, and a sparger system supplies plating solution to the tray. The megasonic transducer array creates a ridge in the plating solution extending upwards a short distance, so that the ridge of solution contacts a substrate placed just above the solution. A microprocessor or similar control assembly associated with the transducer array controls the application of megasonic energy to the array. This also selects which transducers of the array to apply the energy. In this technique the substrate is oriented horizontally and face down so that the ridge contacts the lower face of said substrate. The control assembly, by controlling application of megasonic energy to the transducer array, produces the ridge and changes the position of the ridge relative to the transducer array. The ridge sweeps across the substrate in a controlled fashion, without effecting or requiring relative motion between the substrate and the tray.

In an electroplating arrangement, an anode is positioned in the tray within the electrolyte. This anode can be in the form of an annular member centered over and parallel to the megasonic transducer array, e.g., a ring of ⅜-inch rod. This may favorably be a consumable anode, i.e., of copper in a copper plating application. The megasonic array has a dimension and profile such that the megasonic transducer array is at least coextensive with the face of the wafer or similar substrate. In that case, the anode can have a diameter just less than that of the wafer.

The technique of this invention can be applied favorably to many wet process techniques, e.g., electroless plating and wet-chemistry removal techniques such as chemical etching or planing. As the term is used in the ensuing description and in the claims, "plating" should be taken to include these other wet-process chemical treatments in addition to electroplating.

The above and many other objects, features, and advantages of this invention will become more fully appreciated from the ensuing detailed description of a preferred embodiment, which is to be considered in conjunction with the accompanying Drawing.

DETAILED DESCRIPTION OF THE PREFERRED EMBODIMENT

Figure 1:
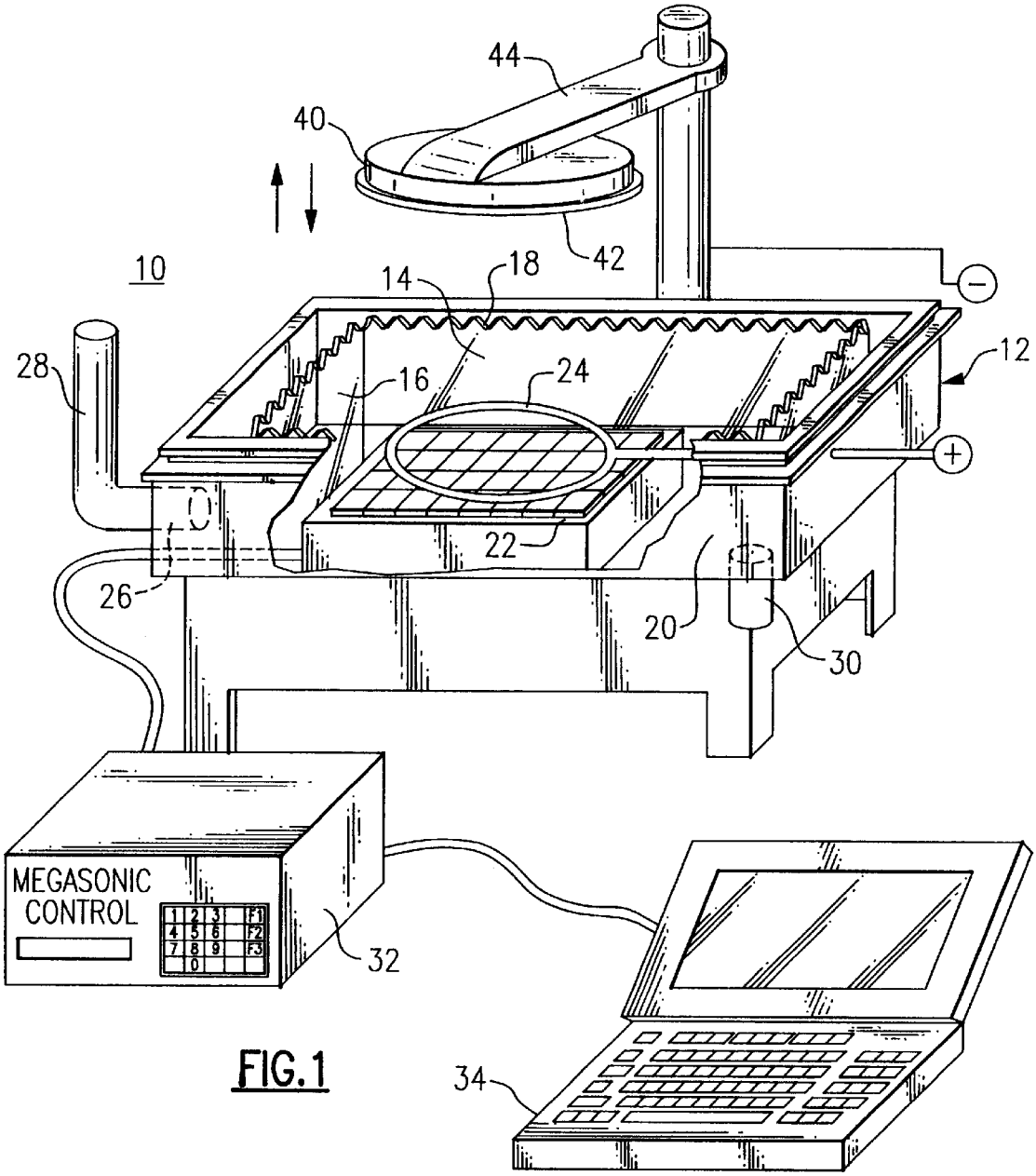
FIG. 1 is a perspective view of a wet-process arrangement according to one preferred embodiment of this invention.
Figure 2:
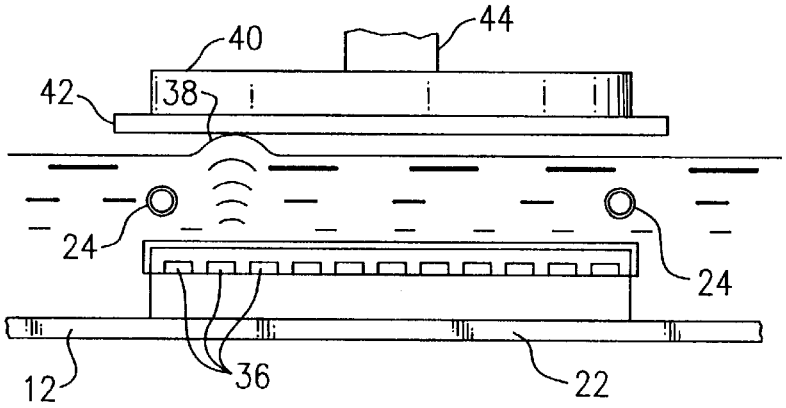
FIG. 2 is a schematic sectional elevation of a portion of this embodiment.

A megasonic plating arrangement 10 according to an embodiment of this invention is illustrated in FIGS. 1 and 2. Although not shown here, the arrangement 10 can be disposed within a cabinet, with a clean air system and automatic wafer handling equipment so that the plating, and possibly other process steps, are carried out automatically for a number of wafers or other to workpieces in sequence. The system also includes fluid treatment and replenishment equipment, which is not shown here but would be understood by those skilled in this art. As shown in the partially cut-away perspective view of FIG. 1, an elongated tray or basin 12 is preferably formed of a durable, non-reactive, non-conductive material such as polypropylene. The tray may be of any suitable dimension, but here is elongated in one horizontal direction, and has an open top. The tray has a central portion 14 whose bounds are defined by a generally rectangular weir 16. As shown in FIG. 2, the weir 16 has a sawtooth upper edge 18 that serves as a spillway for fluid exiting the central portion 14. A trough 20 surrounds the weir 16 and receives any liquid that spills over the weir. A megasonic transducer array 22 is situated in the base of the tray at the central portion 14, and here is of square profile. An anode 24, here in the form of a circular or annular loop, is positioned in the tray above the transducer array 22 and below the surface of the solution. Here the anode 24 is positioned above and centered over the transducer array 22. The anode can be formed of e.g., ⅜-inch metal rod. In some embodiments, stainless steel rod can be used as a permanent anode. In other embodiments, the anode can be consumable, and would be formed of the same metal that is being plated, such as a copper loop for a copper electroplating operation, or a nickel loop for nickel electroplating. One or more spargers 26 introduce a fluid flow into the central portion 14 of the tray 12. The sparger(s) create a laminar, i.e., non-turbulent flow of electrolyte out over the top of the megasonic transducer array 22. A supply tube 28 feeds solution to the sparger(s) 26, and a drain tube 30 conducts away solution that spills over into the trough 20. While not shown here, the drain tube connects with a return conduit to pump, filtration, and fluid conditioning equipment, and the conditioned fluid eventually returns through the supply tube 28 to the sparger (s) 26.

Figure 3:
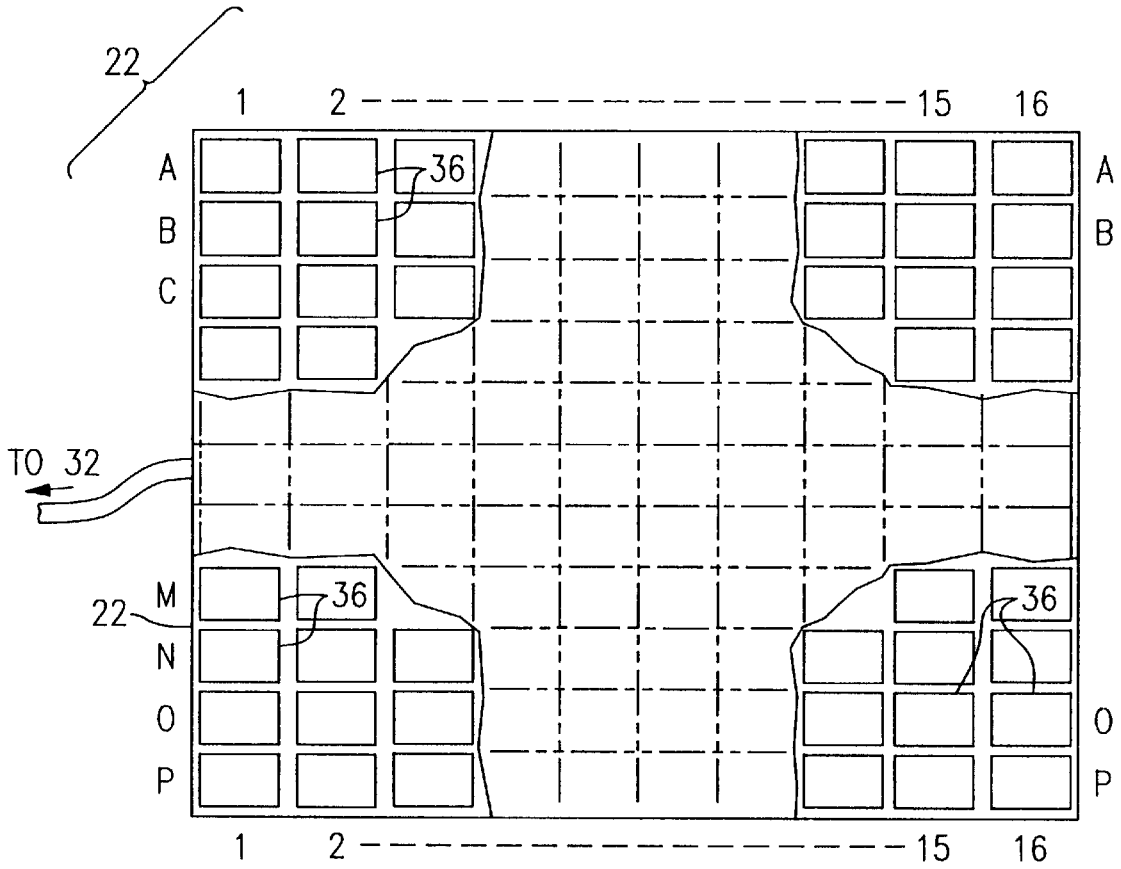
FIG. 3 is a schematic plan view of a megasonic transducer array of this embodiment.
Figure 4:
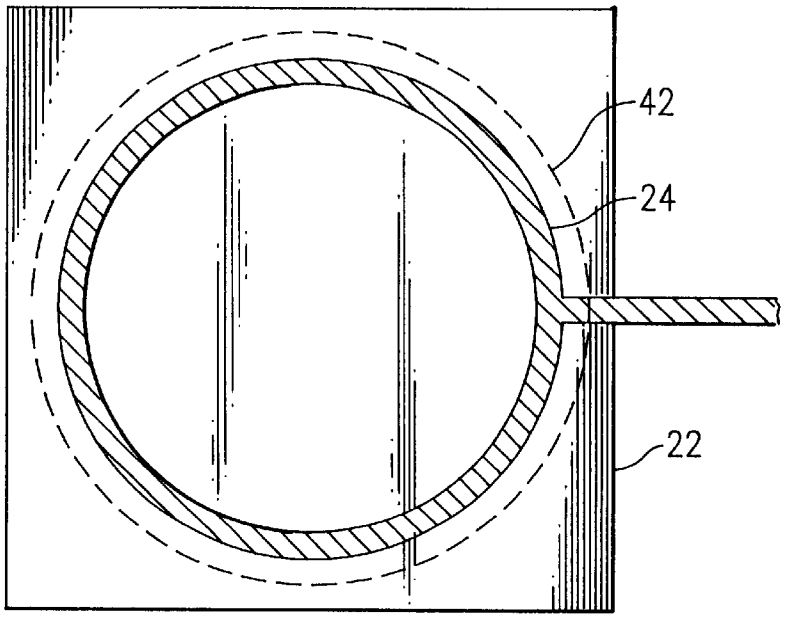
FIG. 4 is a plan view of a portion of this embodiment.

A controlled power supply 32 is connected by a cable to the transducer array 22, and this power supply 32 is connected to a control input device 34, such as a small computer. The power supply 32 may also be self-contained, and may contain a programmable microprocessor and associated control electronics. As also shown in FIG. 3, the transducer array 22 is a rectangular grid of transducer elements or cells 36, in this embodiment the array being sixty-four cells 36, arranged in sixteen rows and sixteen columns. Other configurations are possible, depending upon the application. The transducer cells 36 can be actuated in any configuration, with the controlled power supply 32 having an algorithm for selecting appropriate ones of the cells 36 and providing energy to them in a programmed sequence. The power supply 32 controls the strength and phase of the megasonic energy of the selected cells 36, in this case to produce an elongated ridge 38 of solution, as shown in FIG. 2.

As also shown in FIGS. 1 and 2, a chuck or platen 40 holds a substrate 42, i.e., a silicon wafer. The chuck 40 is supported on a carrier or conveyor 44 that permits the chuck 40 to be lowered to a position, as shown in FIG. 2, in which the substrate 42 is held a short distance above the surface of the solution in the tray 12. At this position, the ridge 38 is in contact with the lower or circuit side of the substrate 42. The ridge 38 can be "walked" or swept across the surface of the substrate as the controlled power supply 32 actuates successive columns of cells of the transducer array 22. It is possible to control the actuation of the array 22 so that the ridge 38 sweeps in one direction, sweeps back and forth, or sweeps in another fashion or pattern. A controlled pattern of ridges 38 may appear at the same time, and these ridges may move in the same or in different, i.e., crossing directions, contacting selected portions of the substrate. The ridge may be created to appear along either the row or column axis, or across a diagonal axis.

The megasonic transducer array 22 directs its energy upwards into the fluid in the tray 12 pushing the fluid upwards, in effect creating the ridge 38 as a fluid wall. The frequency is selected within the megasonic range (nominally 500 KHz to 5 MHz) and the strength of the applied megasonic energy is also chosen so as to achieve a desired shape and height for the ridge 38. A plating current supply (not shown) has its positive side connected to the anode 24 and its negative side connected to the face of the wafer or other substrate 42. The plating supply may A have a nominal plating voltage, e.g., 12 volts.

Of course, in an electroless plating technique, the electrode 24 may be omitted. In other techniques, such as electro-planing, or wet-process etching, the polarity of the applied current may be reversed, with the substrate being connected as anode.

In the technique of this invention, the solution contacts the wafer or other substrate 42 only along a horizontal line of contact, and the electrolyte does not flow to other areas of the wafer face. The plating (or other wet-process treatment) is carried out non-turbulently and only along a well defined zone of contact, resulting in extreme evenness and a high level of repeatability from one wafer to the next.

The wet process operation may involve a single pass or more than one pass, depending on the materials and chemistry involved. Also, in some embodiments, relative motion may also be present as between the tray and the wafer.

While the invention has been described with reference to a preferred embodiment, it should be recognized that the invention is not limited to that precise embodiment, or to the variations herein described. Rather, many modifications and variations would present themselves to persons skilled in the art without departing from the scope and spirit of the invention, as defined in the appended claims.

What is claimed is:

1. A method of wet process treatment of a face of a flat substrate in a plating bath that includes a tray having an open top, a megasonic transducer array situated in said tray, means supplying a wet process treatment solution into said tray wherein the megasonic transducer array creates a ridge in said solution in said tray that can contact the substrate placed above said solution, and means for controllably applying megasonic energy to selected transducers of said array; the method comprising orienting said substrate horizontally and face down so that said ridge contacts the face of said substrate; and controlling the application of megasonic energy to said transducer array to produce said ridge such that the ridge is contiguous with the solution in said tray, and to change the position of the ridge relative to the transducer array and to the substrate.

2. The method of claim 1 wherein said controlling the application of megasonic energy is effective to sweep said ridge across the face of the substrate.

3. The method of claim 1 wherein said controlling the application of megasonic energy is effective to create a pattern of ridges to contact selected portions of said substrate.

4. A method of plating a face of a flat substrate in a plating bath that includes a tray having an open top, a megasonic transducer array situated in said tray, means supplying a plating solution into said tray wherein the megasonic transducer array creates a ridge in said plating solution in said tray that can contact the substrate placed above said solution, and means for controllably applying megasonic energy to selected transducers of said array; the method comprising orienting said substrate horizontally and face down so that said ridge contacts the face of said substrate;

controlling the application of megasonic energy to said transducer array to produce said ridge and to change the position of the ridge relative to the transducer array and to the substrate;

and wherein said plating bath includes an electrode situated above said transducer array, and said method further comprises applying a current between said electrode and said substrate.

5. A method of wet process treatment of a face of a flat substrate in a plating bath that includes a tray having an open top, a megasonic transducer array situated in said tray, means supplying a plating solution into said tray wherein the megasonic transducer array creates a ridge in said wet process treatment solution in said tray that can contact the substrate placed above said solution, and means for controllably applying megasonic energy to selected transducers of said array; the method comprising orienting said substrate horizontally and face down so that said ridge contacts the face of said substrate; and controlling the application of megasonic energy to said transducer array to produce said ridge and to change the position of the ridge relative to the transducer array and to the substrate;

wherein said controlling the application of megasonic energy to produce said ridge and to change the position of the ridge includes holding the substrate and tray steady to avoid effecting relative motion between the substrate and the tray.

6. A method of wet process treatment of a face of a flat substrate in a plating bath that includes a tray having an open top, the substrate having a predetermined diameter, a megasonic transducer array situated in said tray, means supplying a wet process treatment solution into said tray wherein the megasonic transducer array creates a ridge in said solution in said tray that can contact the substrate when placed above said solution, such that said ridge forms a continuous line of contact across the diameter of said substrate, and means for controllably applying megasonic energy to selected transducers of said array; the method comprising:

orienting said substrate horizontally and face down so that said ridge contacts the face of said substrate; and controlling the application of megasonic energy to said transducer array to produce said ridge and to change the position of the ridge relative to the transducer array and to the substrate.

7. A method of wet process treatment of a face of a flat substrate in a plating bath that includes a tray having an open top, a megasonic transducer array situated in said tray, means supplying a wet process treatment solution into said tray wherein the megasonic transducer array creates a ridge in said plating solution in said tray that can contact a substrate placed above said solution, and means for controllably applying megasonic energy to selected transducers of said array; the method comprising:

orienting said substrate horizontally and face down so that said ridge contacts the face of said substrate; and controlling the application of megasonic energy to said transducer array to produce said ridge as a continuous wall of said wet process treatment solution contacting said substrate, and to change the position of the ridge relative to the transducer array and to the substrate.

* * * * *